US010960368B2

(12) United States Patent
Joyce et al.

(10) Patent No.: US 10,960,368 B2
(45) Date of Patent: Mar. 30, 2021

(54) COSMETICS MIXING DEVICE

(71) Applicants: Mariah S. Joyce, Wampum, PA (US); Abigail Rose Rieder, Wampum, PA (US); John Adam Joyce, Wampum, PA (US)

(72) Inventors: Mariah S. Joyce, Wampum, PA (US); Abigail Rose Rieder, Wampum, PA (US); John Adam Joyce, Wampum, PA (US)

( * ) Notice: Subject to any disclaimer, the term of this patent is extended or adjusted under 35 U.S.C. 154(b) by 323 days.

(21) Appl. No.: 16/149,105

(22) Filed: Oct. 1, 2018

(65) Prior Publication Data

US 2020/0101429 A1 Apr. 2, 2020

(51) Int. Cl.

| | |
|---|---|
| ***B22C 5/00*** | (2006.01) |
| ***B01F 11/00*** | (2006.01) |
| ***A45D 44/00*** | (2006.01) |
| ***B01F 15/00*** | (2006.01) |

(52) U.S. Cl.

CPC ..... *B01F 11/0031* (2013.01); *A45D 44/00* (2013.01); *B01F 11/0008* (2013.01); *B01F 15/00519* (2013.01); *B01F 15/00538* (2013.01); *B01F 15/00733* (2013.01); *B01F 2215/0031* (2013.01)

(58) Field of Classification Search

CPC ..... B01F 11/0031; B01F 11/0008; B01F 15/00519; B01F 15/00538; B01F 15/00733; B01F 2215/0031; A45D 44/005; A45D 55/04

See application file for complete search history.

(56) References Cited

U.S. PATENT DOCUMENTS

| | | | | |
|---|---|---|---|---|
| 3,735,964 | A * | 5/1973 | Lorenzen | B01F 11/0017 366/211 |
| 4,523,855 | A * | 6/1985 | Walker | B01F 15/00746 366/211 |
| 5,192,153 | A | 3/1993 | Gueret | |
| 5,226,744 | A | 7/1993 | Kemmerer | |
| 5,399,013 | A | 3/1995 | Sawyer | |
| 6,402,364 | B1 | 6/2002 | Esclar | |
| 6,579,002 | B1 * | 6/2003 | Bartick | B01F 11/0008 366/112 |

(Continued)

FOREIGN PATENT DOCUMENTS

JP 3853877 B2 * 12/2006

*Primary Examiner* — Anshu Bhatia
*Assistant Examiner* — Greg Huan

(57) ABSTRACT

A cosmetics mixing device for homogenizing suspensions of cosmetics includes a housing that defines an interior space. The housing is open-topped, and a block is positioned in the interior space. A plurality of recesses extends into the block from an upper face of the block. Each recess extends from proximate to a first endpoint to proximate to a second endpoint of the block. Each of a plurality of couplers is coupled to the block and is positioned in a respective recess. The coupler is configured to couple to a respective tubular container to retain the respective tubular container within the respective recess. A shaking module that is coupled to the housing and positioned in the interior space is operationally coupled to the block. The shaking module is positioned to shake the block to mix a cosmetic that is positioned in the respective tubular container.

15 Claims, 5 Drawing Sheets

(56) References Cited

U.S. PATENT DOCUMENTS

| | | | | |
|---|---|---|---|---|
| 9,211,513 | B1 * | 12/2015 | Korpela | B01F 13/00 |
| 2006/0273136 | A1 | 12/2006 | Bachman | |
| 2020/0030759 | A1 * | 1/2020 | Stiver | B01F 11/0017 |
| 2020/0037728 | A1 * | 2/2020 | Davidov | A45D 42/00 |

* cited by examiner

COSMETICS MIXING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to mixing devices and more particularly pertains to a new mixing device for homogenizing suspensions of cosmetics.

BRIEF SUMMARY OF THE INVENTION

An embodiment of the disclosure meets the needs presented above by generally comprising a housing that defines an interior space. The housing is open-topped, and a block is positioned in the interior space. A plurality of recesses extends into the block from an upper face of the block. Each recess extends from proximate to a first endpoint to proximate to a second endpoint of the block. Each of a plurality of couplers is coupled to the block and is positioned in a respective recess. The coupler is configured to couple to a respective tubular container to retain the respective tubular container within the respective recess. A shaking module that is coupled to the housing and positioned in the interior space is operationally coupled to the block. The shaking module is positioned to shake the block to mix a cosmetic that is positioned in the respective tubular container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
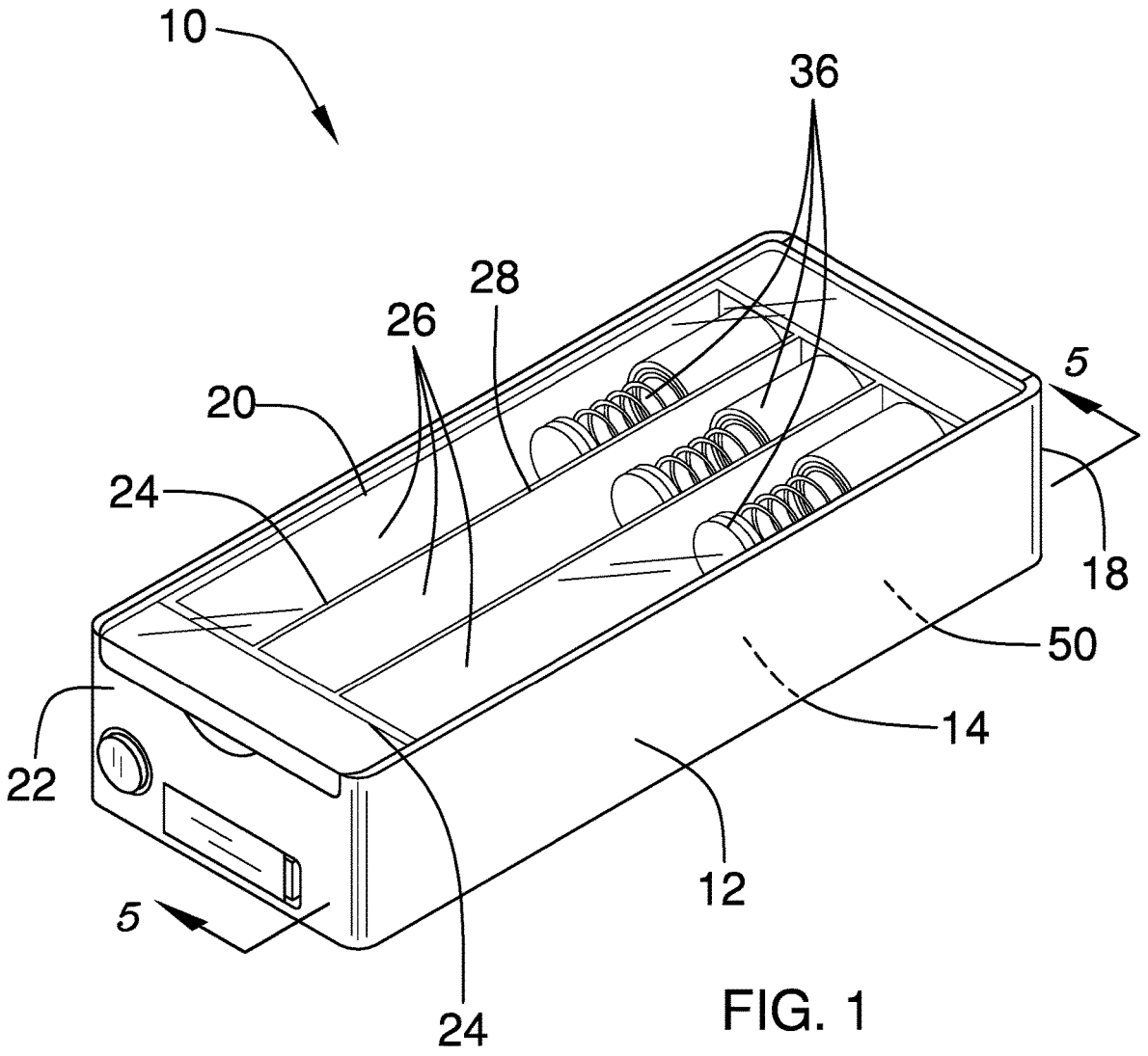
FIG. 1 is an isometric perspective view of a cosmetics mixing device according to an embodiment of the disclosure.

With reference now to the drawings, and in particular to FIGS. 1 through 6 thereof, a new mixing device embodying the principles and concepts of an embodiment of the disclosure and generally designated by the reference numeral 10 will be described.

Figure 2:
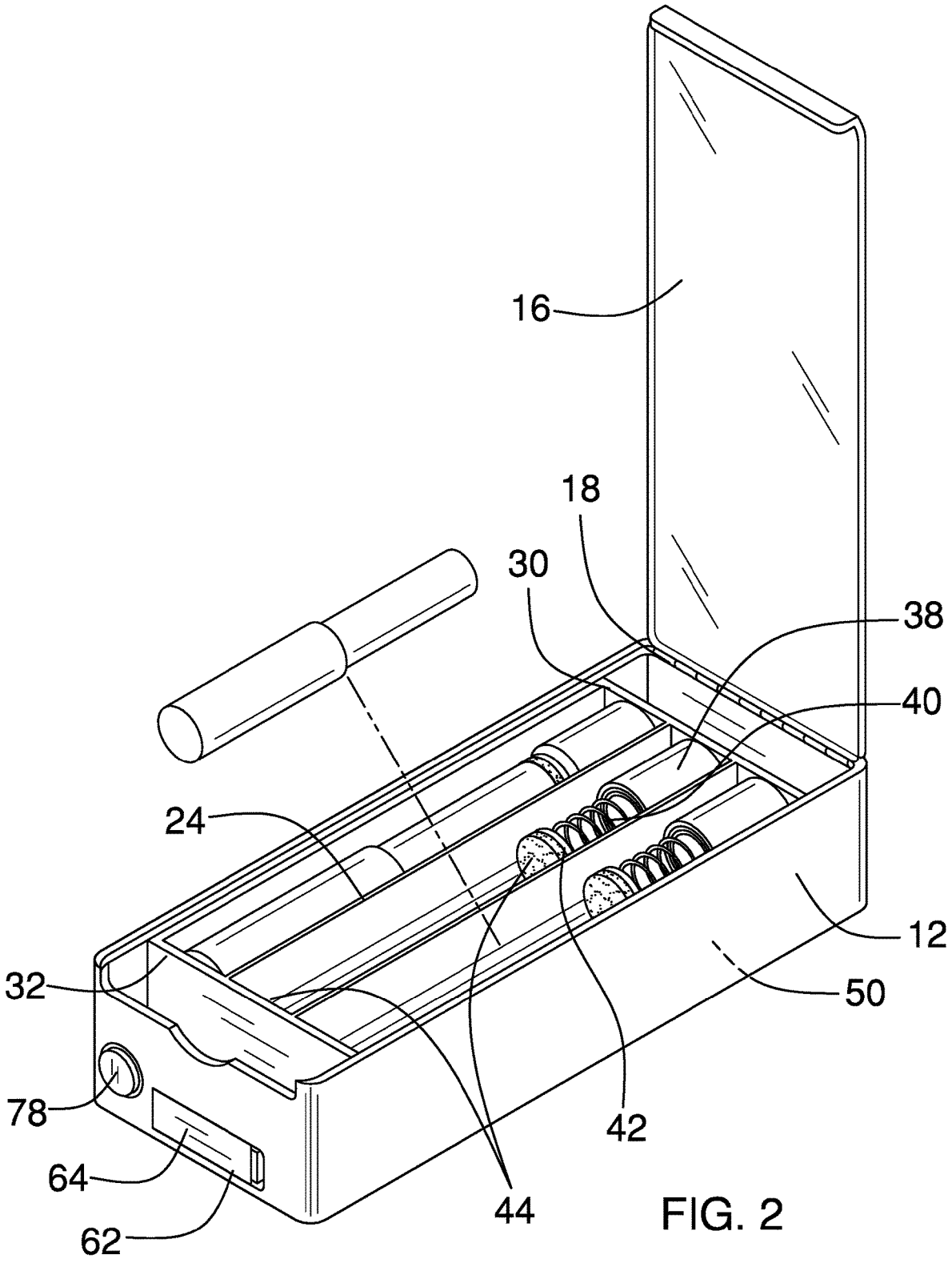
FIG. 2 is an isometric perspective view of an embodiment of the disclosure.

As best illustrated in FIGS. 1 through 6, the cosmetics mixing device 10 generally comprises a housing 12 that defines an interior space 14. The housing 12 is open-topped and rectangularly box shaped. A lid 16 is hingedly coupled to a first end 18 proximate to a top 20 of the housing 12, as shown in FIG. 2. The lid 16, which is substantially transparent, is selectively couplable to a second end 22 of the housing 12. The lid 16 is positioned to selectively pivot relative to the housing 12, positioning the lid 16 to couple to the housing 12 to close the top 20.

A block 24, which is rectangularly box shaped, is positioned in the interior space 14. A plurality of recesses 26 extends into the block 24 from an upper face 28 of the block 24, as shown in FIG. 2. Each recess 26 extends from proximate to a first endpoint 30 to proximate to a second endpoint 32 of the block 24. The plurality of recesses 26 comprises three recesses 26, with each recess 26 being shaped complementarily to a respective tubular container.

Figure 3:
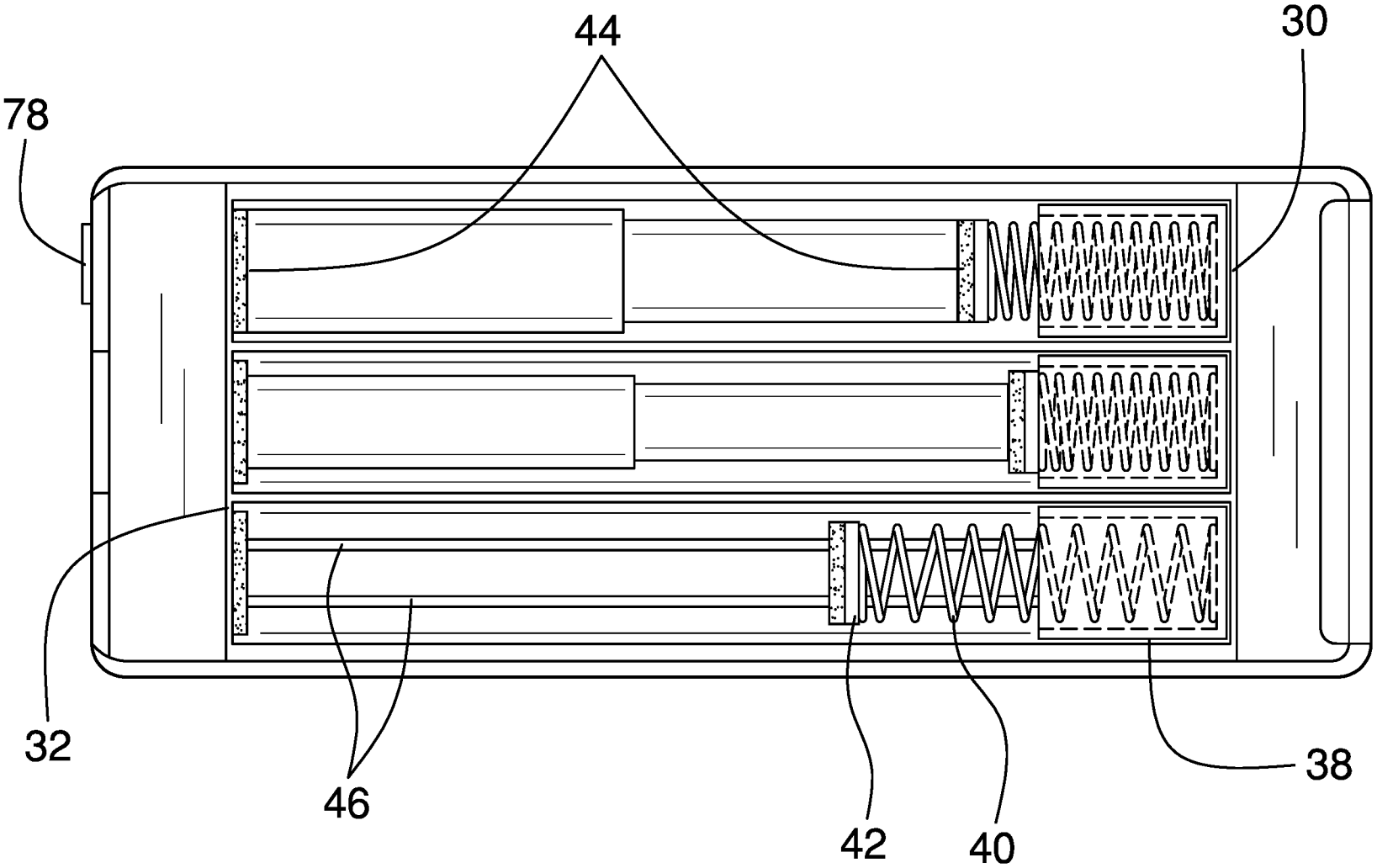
FIG. 3 is a top view of an embodiment of the disclosure.

Each of a plurality of couplers 36 is coupled to the block 24 and positioned in a respective recess 26, as shown in FIG. 3. The coupler 36 is configured to couple to the respective tubular container to retain the respective tubular container within the respective recess 26. Each coupler 36 comprises a tube 38 that is positioned in the respective recess 26 and coupled to the first endpoint 30 of the block 24. A spring 40 is positioned in the tube 38 and is coupled to the block 24. The spring 40 extends from the tube 38 into the respective recess 26. A disc 42 is coupled to the spring 40 distal from the tube 38. The disc 42 is configured to abut one end of the respective tubular container, positioning a user to compress the spring 40 into the tube 38 so that the other end of the respective tubular container is positionable in abutment to the second endpoint 32 of the block 24. The spring 40 is configured to retain the respective tubular container within the respective recess 26.

A pair of pads 44 is coupled singly to the second endpoint 32 of the block 24 and the disc 42, as shown in FIG. 3. The pads 44 are resiliently compressible and are configured to frictionally couple to the respective tubular container. The pads 44 comprise foamed elastomer.

Figure 6:
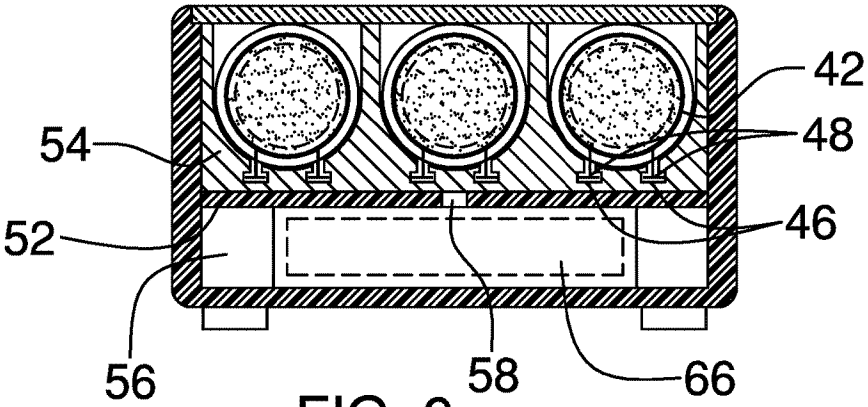
FIG. 6 is a cross-sectional view of an embodiment of the disclosure.

A pair of channels 46 extends from the respective recess 26 into the block 24, as shown in FIG. 6. The channels 46 are parallel and are positioned longitudinally within the respective recess 26. A pair of tabs 48 is coupled to and extends from the disc 42 so that each tab 48 is positioned in a respective channel 46 to slidably couple the disc 42 to the block 24. The tabs 48 are positioned to retain the disc 42 in alignment with the tube 38 as the spring 40 is compressed and rebounds.

A shaking module 50 is coupled to the housing 12 and is positioned in the interior space 14. The shaking module 50 is operationally coupled to the block 24. The shaking module 50 is positioned to shake the block 24 to mix a cosmetic that is positioned in the respective tubular container. Many cosmetics comprises mixtures of two or more liquids, or one or more solids in a liquid, and they may separate. The device 10 allows a user to obtain a homogeneous mixture prior to applying the cosmetic.

A wall 52 is coupled to the housing 12 and positioned in the interior space 14 to define an upper chamber 54 and a lower chamber 56. The block 24 is positioned in the upper chamber 54 and the shaking module 50 is positioned in the lower chamber 56. A slot 58 is positioned through the wall 52. The slot 58 is perpendicular to the first end 18 of the housing 12.

The shaking module 50 comprises a battery 60. An orifice 62 is positioned in the second end 22 of the housing 12 proximate to the battery 60, as shown in FIG. 2. The orifice 62 is configured to permit access to the lower chamber 56 to replace the battery 60. A panel 64 is selectively couplable to the housing 12 to close the orifice 62.

Figure 4:
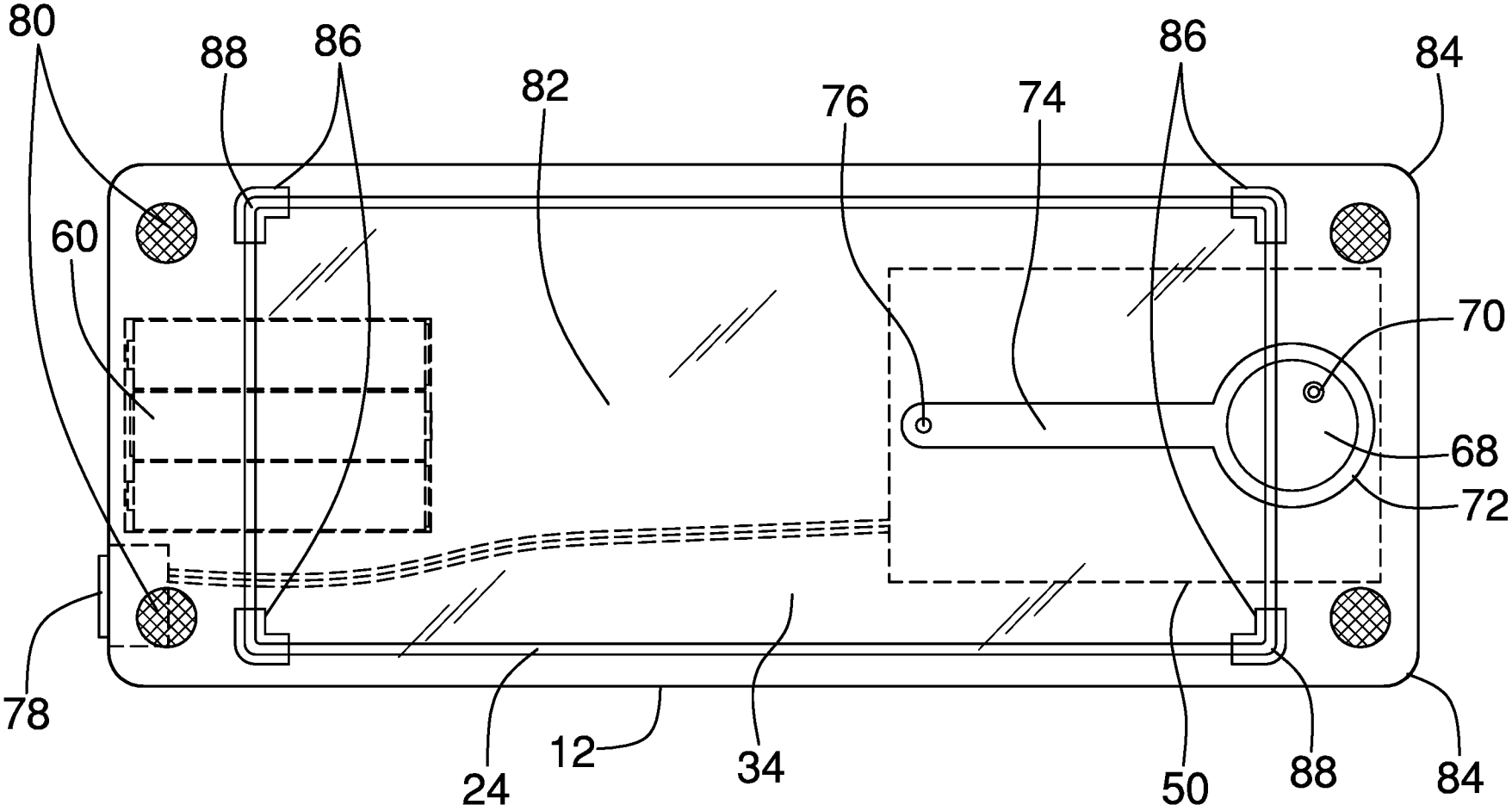
FIG. 4 is a bottom view of an embodiment of the disclosure.
Figure 5:
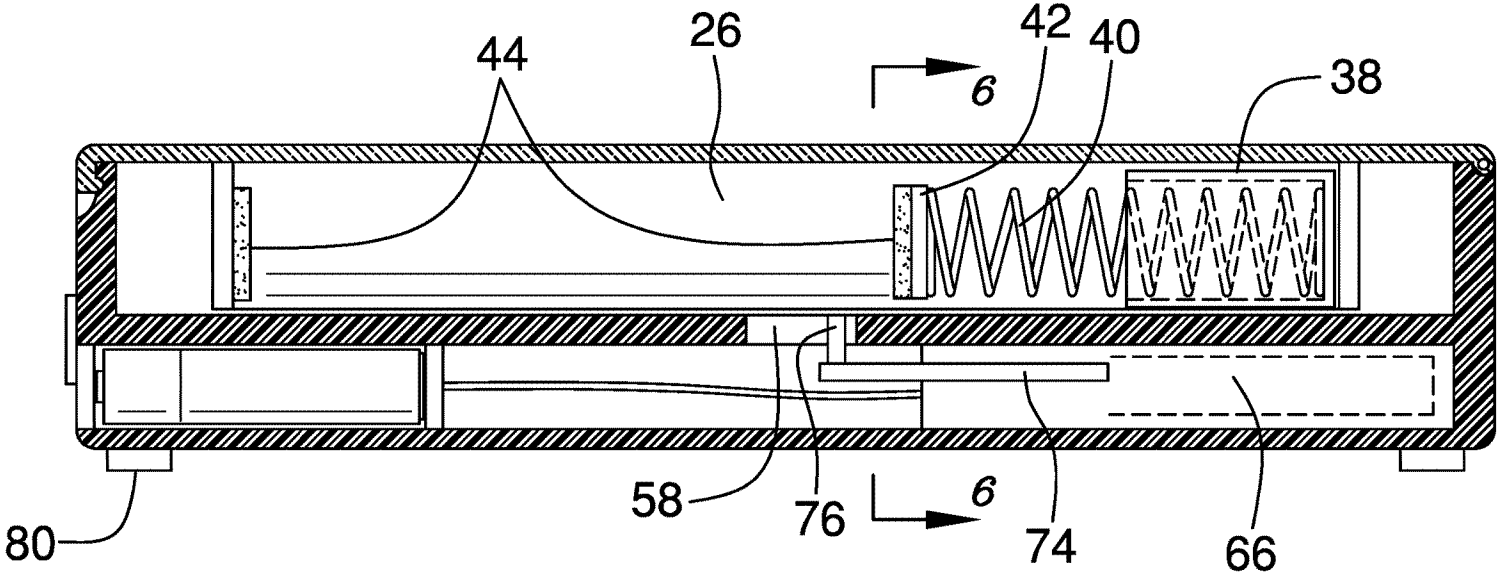
FIG. 5 is a cross-sectional view of an embodiment of the disclosure.

The shaking module 50 also comprises a motor 66, which is coupled to the housing 12. The motor 66 is operationally coupled to the battery 60. A wheel 68, which is eccentric, is coupled to a shaft 70 that extends from the motor 66, as shown in FIG. 4. A bracket 72 is rotationally coupled to the wheel 68. An arm 74 is coupled to and extends from the bracket 72. A pin 76 is coupled to the arm 74 distal from the bracket 72 and extends through the slot 58. The pin 76 is coupled to the block 24.

A button 78 is coupled to the second end 22 of the housing 12. The button 78 is depressible. The button 78 is operationally coupled to the battery 60 and the motor 66. The button 78 is configured to be depressed a first time to operationally couple the motor 66 to the battery 60 so that the motor 66 is positioned to rotate the wheel 68, causing the arm 74 to urge the block 24 alternately toward the first end 18 and the second end 22 of the housing 12 in rapid repetition so that the block 24 and the respective tubular container are shaken. The button 78 is configured to be depressed a second time to decouple the motor 66 from the battery 60.

A plurality of feet 80 is coupled to a bottom 82 of the housing 12, as shown in FIG. 4. The feet 80 comprise rubber so that the feet 80 are configured to frictionally couple to a surface to deter slippage of the housing 12 on the surface. The plurality of feet 80 comprises four feet 80 that are positioned singly proximate to corners 84 of the bottom 82.

A mirror 34 is coupled to the bottom 82 of the housing 12, as shown in FIG. 4. The mirror 34 can be used to assist in application of the cosmetics. Each of a set of four covers 86 is coupled to a respective corner 88 of the mirror 34.

In use, up to three tubular containers are inserted singly into the recesses 26 by placing the one end of the tubular container against the pad 44 that is coupled to the disc 42 and pushing against the spring 40 so that the other end of the tubular container is insertable into the recess 26. The lid 16 is closed and the button 78 is pushed to actuate the motor 66. The rotation of the wheel 68 induces lateral movement in the arm 74 that is transferred to the block 24, and thus the tubular container, to mix the cosmetic in the tubular container.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

We claim:

1. A cosmetics mixing device comprising:

a housing defining an interior space, the housing being open-topped;

a block positioned in the interior space;

a plurality of recesses extending into the block from an upper face of the block, each recess extending from proximate to a first endpoint to proximate to a second endpoint of the block;

a plurality of couplers, each coupler being coupled to the block and positioned in a respective recess wherein the coupler is configured for coupling to a respective tubular container for retaining the respective tubular container within the respective recess;

a shaking module coupled to the housing and positioned in the interior space, the shaking module being operationally coupled to the block wherein the shaking module is positioned for shaking the block for mixing a cosmetic positioned in the respective tubular container;

a mirror coupled to a bottom of the housing; and a set of four covers, each cover being coupled to a respective corner of the mirror.

2. The device of claim 1, further including a lid hingedly coupled to a first end proximate to a top of the housing, the lid being selectively couplable to a second end of the housing wherein the lid is positioned for selectively pivoting relative to the housing positioning the lid for coupling to the housing for closing the top.

3. The device of claim 2, further including the lid being substantially transparent.

4. The device of claim 1, further comprising:

the housing and the block being rectangularly box shaped;

a wall coupled to the housing and positioned in the interior space defining an upper chamber and a lower chamber, the shaking module being positioned in the lower chamber, the block being positioned in the upper chamber; and a slot positioned through the wall, the slot being perpendicular to a first end of the housing.

5. The device of claim 4, further including the shaking module comprising:

a battery;

a motor coupled to the housing, the motor being operationally coupled to the battery;

a wheel coupled to a shaft extending from the motor, the wheel being eccentric;

a bracket rotationally coupled to the wheel;

an arm coupled to and extending from the bracket;

a pin coupled to the arm distal from the bracket, the pin extending through the slot, the pin being coupled to the block; and a button coupled to the second end of the housing, the button being depressible, the button being operationally coupled to the battery and the motor wherein the button is configured for depressing a first time for operationally coupling the motor to the battery such that the motor is positioned for rotating the wheel such that the arm urges the block alternately toward the first end and the second end of the housing in rapid repetition such that the block and the respective tubular container are shaken, wherein the button is configured for depressing a second time for decoupling the motor from the battery.

6. The device of claim 1, further including the plurality of recesses comprising three recesses.

7. The device of claim 1, further including each recess being shaped complementarily to the respective tubular container.

8. The device of claim 1, further including a plurality of feet coupled to a bottom of the housing, the feet comprising rubber wherein the feet are configured for frictionally coupling to a surface for deterring slippage of the housing on the surface.

9. The device of claim 8, further including the plurality of feet comprising four feet positioned singly proximate to corners of the bottom.

10. The device of claim 1, further comprising:

the housing being rectangularly box shaped;

a lid hingedly coupled to a first end proximate to a top of the housing, the lid being selectively couplable to a second end of the housing wherein the lid is positioned for selectively pivoting relative to the housing positioning the lid for coupling to the housing for closing the top, the lid being substantially transparent;

the block being rectangularly box shaped;

a wall coupled to the housing and positioned in the interior space defining an upper chamber and a lower chamber, the block being positioned in the upper chamber;

the plurality of recesses comprising three recesses, each recess being shaped complementarily to a respective tubular container;

each coupler comprising:

a tube positioned in the respective recess and coupled to the first endpoint of the block, a spring positioned in the tube and coupled to the block, the spring extending from the tube into the respective recess, a disc coupled to the spring distal from the tube wherein the disc is configured for abutting one end of the respective tubular container positioning a user for compressing the spring into the tube such that the other end of the respective tubular container is positionable in abutment to the second endpoint of the block wherein the spring is configured for retaining the respective tubular container within the respective recess, a pair of pads, the pads being coupled singly to the second endpoint of the block and the disc, the pads being resiliently compressible wherein the pads are configured for frictionally coupling to the respective tubular container, the pads comprising foamed elastomer, a pair of channels extending from the respective recess into the block, the channels being parallel, the channels being positioned longitudinally within the respective recess, and a pair of tabs coupled to and extending from the disc such that each tab is positioned in a respective channel for slidably coupling the disc to the block wherein the tabs are positioned for retaining the disc in alignment with the tube as the spring is compressed and rebounds;

a slot positioned through the wall, the slot being perpendicular to the first end of the housing;

the shaking module being positioned in the lower chamber, the shaking module comprising:

a battery, an orifice positioned in the second end of the housing proximate to the battery wherein the orifice is configured for accessing the lower chamber for replacing the battery, a panel selectively couplable to the housing for closing the orifice, a motor coupled to the housing, the motor being operationally coupled to the battery, a wheel coupled to a shaft extending from the motor, the wheel being eccentric, a bracket rotationally coupled to the wheel, an arm coupled to and extending from the bracket, a pin coupled to the arm distal from the bracket, the pin extending through the slot, the pin being coupled to the block, and a button coupled to the second end of the housing, the button being depressible, the button being operationally coupled to the battery and the motor wherein the button is configured for depressing a first time for operationally coupling the motor to the battery such that the motor is positioned for rotating the wheel such that the arm urges the block alternately toward the first end and the second end of the housing in rapid repetition such that the block and the respective tubular container are shaken, wherein the button is configured for depressing a second time for decoupling the motor from the battery; and a plurality of feet coupled to a bottom of the housing, the feet comprising rubber wherein the feet are configured for frictionally coupling to a surface for deterring slippage of the housing on the surface, the plurality of feet comprising four feet positioned singly proximate to corners of the bottom.

11. A cosmetics mixing device comprising:

a housing defining an interior space, the housing being open-topped;

a block positioned in the interior space;

a plurality of recesses extending into the block from an upper face of the block, each recess extending from proximate to a first endpoint to proximate to a second endpoint of the block;

a plurality of couplers, each coupler being coupled to the block and positioned in a respective recess wherein the coupler is configured for coupling to a respective tubular container for retaining the respective tubular container within the respective recess;

a shaking module coupled to the housing and positioned in the interior space, the shaking module being operationally coupled to the block wherein the shaking module is positioned for shaking the block for mixing a cosmetic positioned in the respective tubular container; and each coupler comprising:

a tube positioned in the respective recess and coupled to the first endpoint of the block;

a spring positioned in the tube and coupled to the block, the spring extending from the tube into the respective recess; and a disc coupled to the spring distal from the tube wherein the disc is configured for abutting one end of the respective tubular container positioning a user for compressing the spring into the tube such that the other end of the respective tubular container is positionable in abutment to the second endpoint of the block wherein the spring is configured for retaining the respective tubular container within the respective recess.

12. The device of claim 11, further including a pair of pads, the pads being coupled singly to the second endpoint of the block and the disc, the pads being resiliently compressible wherein the pads are configured for frictionally coupling to the respective tubular container.

13. The device of claim 12, further including the pads comprising foamed elastomer.

14. The device of claim 11, further comprising:

a pair of channels extending from the respective recess into the block, the channels being parallel, the channels being positioned longitudinally within the respective recess; and a pair of tabs coupled to and extending from the disc such that each tab is positioned in a respective channel for slidably coupling the disc to the block wherein the tabs are positioned for retaining the disc in alignment with the tube as the spring is compressed and rebounds.

15. A cosmetics mixing device comprising:

a housing defining an interior space, the housing being open-topped;

a block positioned in the interior space, the housing and the block being rectangularly box shaped;

a plurality of recesses extending into the block from an upper face of the block, each recess extending from proximate to a first endpoint to proximate to a second endpoint of the block;

a plurality of couplers, each coupler being coupled to the block and positioned in a respective recess wherein the coupler is configured for coupling to a respective tubular container for retaining the respective tubular container within the respective recess;

a shaking module coupled to the housing and positioned in the interior space, the shaking module being operationally coupled to the block wherein the shaking module is positioned for shaking the block for mixing a cosmetic positioned in the respective tubular container, the shaking module comprising a battery, a motor coupled to the housing, the motor being operationally coupled to the battery, a wheel coupled to a shaft extending from the motor, the wheel being eccentric, a bracket rotationally coupled to the wheel, an arm coupled to and extending from the bracket, a pin coupled to the arm distal from the bracket, the pin extending through the slot, the pin being coupled to the block, and a button coupled to the second end of the housing, the button being depressible, the button being operationally coupled to the battery and the motor wherein the button is configured for depressing a first time for operationally coupling the motor to the battery such that the motor is positioned for rotating the wheel such that the arm urges the block alternately toward the first end and the second end of the housing in rapid repetition such that the block and the respective tubular container are shaken, wherein the button is configured for depressing a second time for decoupling the motor from the battery;

a wall coupled to the housing and positioned in the interior space defining an upper chamber and a lower chamber, the shaking module being positioned in the lower chamber, the block being positioned in the upper chamber;

a slot positioned through the wall, the slot being perpendicular to a first end of the housing;

an orifice positioned in the second end of the housing proximate to the battery wherein the orifice is configured for accessing the lower chamber for replacing the battery; and a panel selectively couplable to the housing for closing the orifice.

* * * * *